US010392791B2

(12) United States Patent
Swanston

(10) Patent No.: US 10,392,791 B2
(45) Date of Patent: Aug. 27, 2019

(54) WEIR GRATE

(71) Applicant: William Francis Swanston, Sydney (AU)

(72) Inventor: William Francis Swanston, Sydney (AU)

( * ) Notice: Subject to any disclaimer, the term of this patent is extended or adjusted under 35 U.S.C. 154(b) by 0 days.

(21) Appl. No.: 15/660,820

(22) Filed: Jul. 26, 2017

(65) Prior Publication Data

US 2017/0362809 A1 Dec. 21, 2017

Related U.S. Application Data

(63) Continuation of application No. 14/565,743, filed on Dec. 10, 2014, now Pat. No. 9,745,734, which is a continuation of application No. 13/145,974, filed as application No. PCT/AU2010/000064 on Jan. 22, 2010, now abandoned.

(30) Foreign Application Priority Data

Jan. 22, 2009 (AU) ..... 2009900257

(51) Int. Cl.

| | |
|---|---|
| ***E03F 5/04*** | (2006.01) |
| ***E03F 5/06*** | (2006.01) |
| ***E03C 1/22*** | (2006.01) |
| ***B21D 31/00*** | (2006.01) |
| ***B21D 28/24*** | (2006.01) |

(52) U.S. Cl.

CPC ..... *E03F 5/06* (2013.01); *B21D 28/24* (2013.01); *B21D 31/00* (2013.01); *E03C 1/22* (2013.01); *E03F 5/0407* (2013.01); *E03F 5/0408* (2013.01); *E03C 2201/00* (2013.01); *Y10T 29/49826* (2015.01)

(58) Field of Classification Search

CPC ..... E03C 1/12; E03C 1/22; E03C 2001/22; E03C 2201/00; E03F 5/0407; E03F 5/0408; E03F 5/0409; E03F 5/06

USPC ..... 210/163, 164, 165, 232, 474; 4/679; 52/302.1

See application file for complete search history.

(56) References Cited

U.S. PATENT DOCUMENTS

| | | | |
|---|---|---|---|
| 3,529,723 | A | 9/1970 | Hagedorn |
| 4,067,072 | A | 1/1978 | Izzi |
| 4,370,876 | A | 2/1983 | Ballard et al. |

(Continued)

FOREIGN PATENT DOCUMENTS

| | | |
|---|---|---|
| CN | 2690464 Y | 4/2005 |
| CN | 2869151 | 2/2007 |

(Continued)

OTHER PUBLICATIONS

Apr. 2005, English translation of Chinese application No. CN 2690464Y, Yes; Cited in Parent U.S. Appl. No. 13/145,974.

(Continued)

*Primary Examiner* — Christopher Upton

(74) *Attorney, Agent, or Firm* — Neifeld IP Law, PC

(57) ABSTRACT

A weir grate (100') comprises a base tray (112) having a plate (120). The plate (120) comprises an upstanding wall (121) arranged to form a periphery of the plate. The plate further comprises a lip (180, 180') that projects laterally from and around an in-use upper end of the peripheral wall (121). An infill tray (116) may be positioned in the base tray (112).

17 Claims, 10 Drawing Sheets

(56) References Cited

U.S. PATENT DOCUMENTS

| | | | | |
|---|---|---|---|---|
| 4,505,814 | A | 3/1985 | Marshall | |
| 4,910,811 | A | 3/1990 | Izzi, Sr. | |
| 6,687,925 | B2 | 2/2004 | Minnick | |
| 6,722,177 | B1 | 4/2004 | Walsh | |
| 6,755,966 | B1 * | 6/2004 | Reed | E03F 5/0408 210/164 |
| 9,745,734 | B2 * | 8/2017 | Swanston | E03C 1/22 |
| 2006/0225194 | A1 | 10/2006 | O'Neill | |
| 2007/0034577 | A1 | 2/2007 | Baynard et al. | |
| 2007/0177942 | A1 | 8/2007 | Meyers | |
| 2008/0148474 | A1 | 6/2008 | Witt | |
| 2012/0036630 | A1 | 2/2012 | Cook | |

FOREIGN PATENT DOCUMENTS

| | | |
|---|---|---|
| DE | 202005004087 | 6/2005 |
| EP | 0687784 | 12/1995 |
| EP | 1806456 | 7/2007 |
| FR | 2286590 | 4/1976 |
| JP | H05-054676 | 7/1993 |
| WO | WO 2008/112814 | 9/2008 |

OTHER PUBLICATIONS

Oct. 2014, Australian Application No. 2010206499—Examination Report No. 1 dated Oct. 23, 2014, which has issued on a corresponding application, Cited in Parent U.S. Appl. No. 13/145,974.

Sep. 2010, International Search Report for PCT/AU2010/000064, Cited in Parent U.S. Appl. No. 13/145,974.

Apr. 2011, IPRP for PCT/AU2010/000064, Cited in Parent U.S. Appl. No. 13/145,974.

Jun. 3, 2013, Office action as issue din Chines patent application 201080012893.1, Cited in Parent U.S. Appl. No. 13/145,974.

Jul. 1993, English translation of Section(s) [009] and [0010] of JP Utility Model Publication No. 5-54676, Cited in Parent U.S. Appl. No. 13/145,974.

Aug. 20, 2013, Original Japanese Office Action as issued in corresponding Japanese application 2011-546529, Cited in Parent U.S. Appl. No. 13/145,974.

Aug. 20, 2013, English translatton of Office Action as issued in corresponding Japanese application 2011-546529, Cited in Parent U.S. Appl. No. 13/145,974.

Jan. 14, 2014, English translation of second office action as issued in corresponding Chinese application 201080012893, Cited in Parent U.S. Appl. No. 13/145,974.

Nov. 2014, Supplementary European Search Report in Application No. EP 10733150, Cited in Parent U.S. Appl. No. 14/565,743.

* cited by examiner

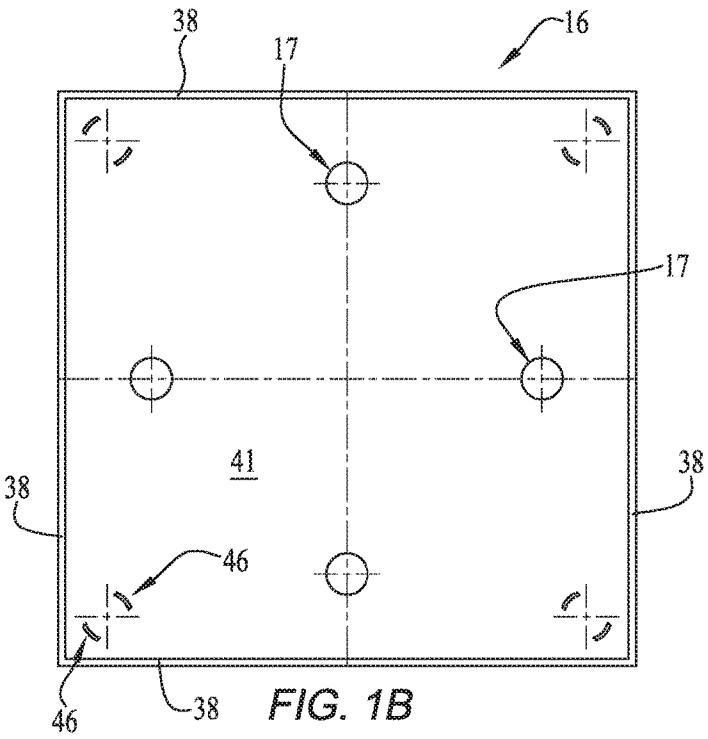
FIG. 1B
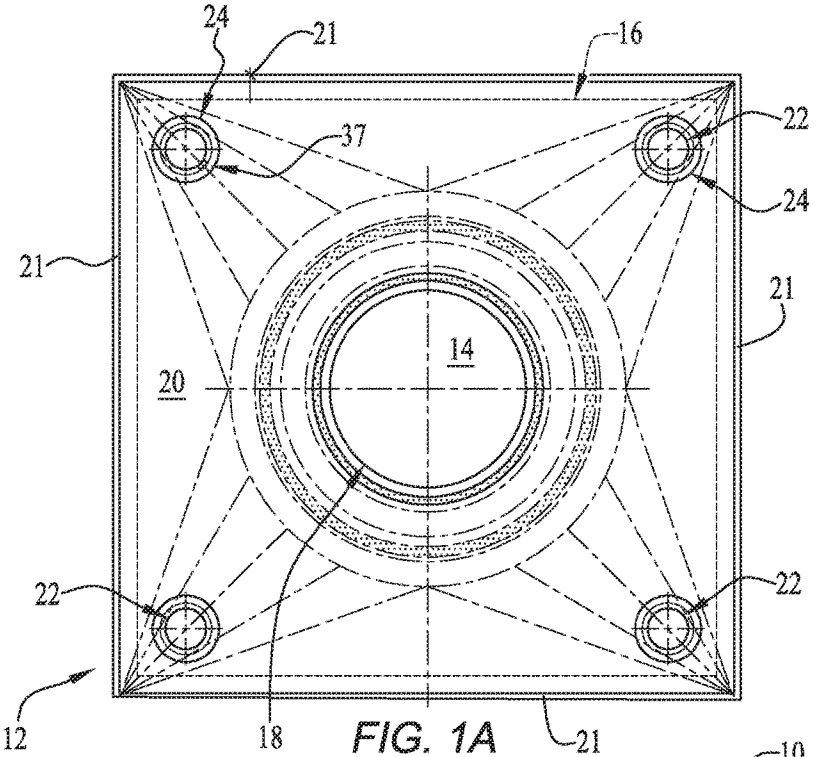
FIG. 1A
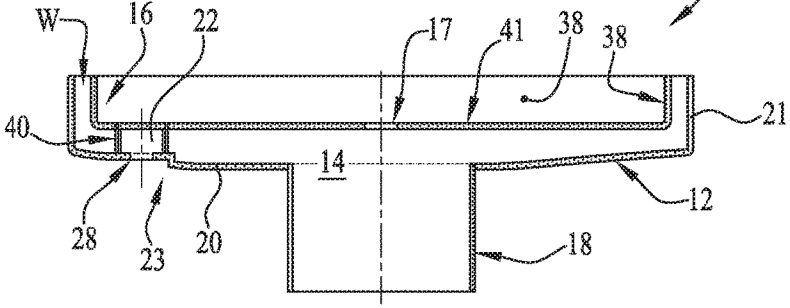
FIG. 1C
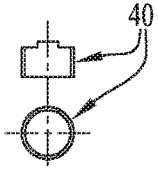
FIG. 2a
FIG. 2b
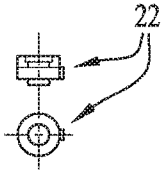
FIG. 2c
FIG. 2d

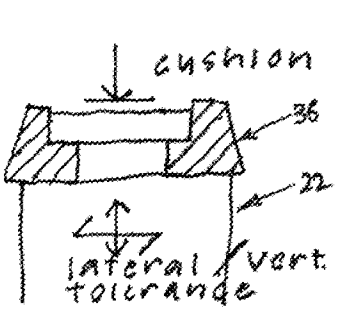
FIG. 3f
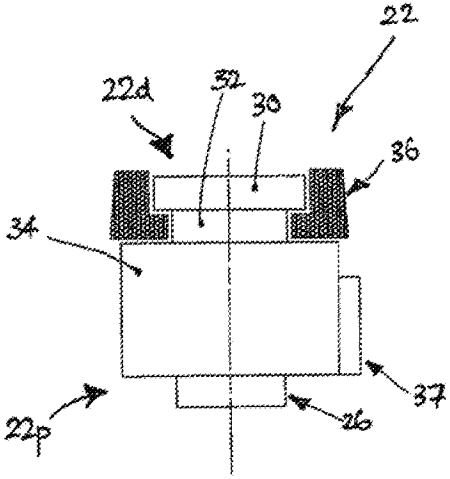
FIG. 3d
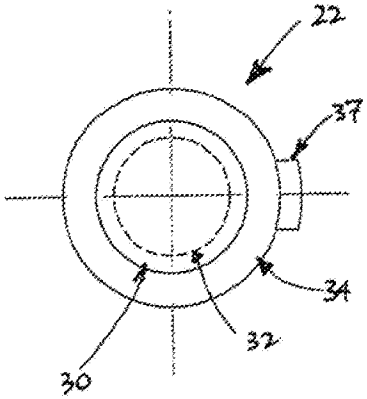
FIG. 3e
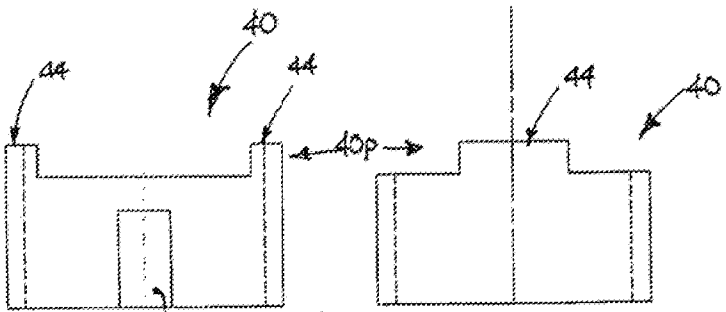
FIG. 3b
FIG. 3a
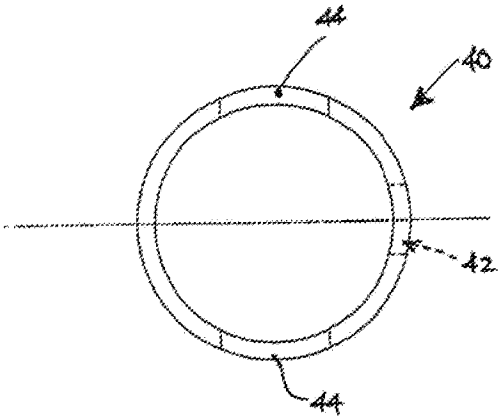
FIG. 3c

WEIR GRATE

CROSS REFERENCE TO RELATED APPLICATIONS

This application is a continuation of application Ser. No. 14/565,743, filed Dec. 10, 2014, which is a continuation of application Ser. No. 13/145,974, filed Oct. 10, 2011, which is a US national stage entry of PCT/AU2010/000064, filed Jan. 22, 2010, which claims priority to AU 2009900257, filed Jan. 22, 2009. The contents of application Ser. No. 14/565,743, filed Dec. 10, 2014, application Ser. No. 13/145,974, filed Oct. 10, 2011, PCT/AU2010/000064, filed Jan. 22, 2010, and AU 2009900257, filed Jan. 22, 2009, are incorporated by reference herein.

TECHNICAL FIELD

A weir grate and methods for constructing and installing the grate are disclosed. The configuration of the grate is such that it may be rapidly formed from sheet metal, making it cost effective to produce.

BACKGROUND ART

Weir grates provide a design alternative to floor-mounted drainage grates (also known as drainage wastes) that comprise multiple holes, often forming a pattern. Weir and drainage grates are predominantly die-cast because this technique allows for low-cost and mass production of grates of acceptable quality, using brass, zinc and other non-ferrous metals. The technique is able to produce complicated grate shapes, but requires an electro-plating step to obtain a grate with a surface appearance that is acceptable to a consumer (e.g. a chrome-like polished surface finish).

To enable grates to be directly formed from higher melting point ferrous metals such as stainless steel, investment casting has been employed. However, compared to die-casting, investment casting results in increased production time, lower volume output, more costly casting raw materials, thicker walled products and, often, the need for a subsequent wall straightening step.

A reference to such background art is not an admission that the art forms a part of the common general knowledge of a person of ordinary skill in the art in Australia or elsewhere.

SUMMARY OF THE DISCLOSURE

Disclosed herein is a weir grate comprising a base tray having an outlet, and an infill tray positionable in the base tray. The base tray comprises a plurality of discretely positioned posts projecting upwardly therefrom in use, and the infill tray comprises a plurality of correspondingly positioned locators projecting downwardly therefrom in use. Each locator is arranged for engaging with a respective post when the infill tray is positioned in the base tray.

The provision of posts and respective locators enables each of the base tray and infill tray to be formed from sheet metal (e.g. by being cut from a larger sheet and then press-formed into the tray shape). In this regard, the posts/locators can function to locate, space and support the infill tray within and above the base tray in use, thereby avoiding the need for more complicated cast components. This improved grate configuration enables a grate to be mass produced from ferrous metals such as stainless steel in a low-cost, systematic and high volume manner.

In one embodiment each post is solid. In this regard, each post can be machined (e.g. in a CNC lathe) from solid metal rod (e.g. of standard, widely available rodstock). In some applications the post may be cast (e.g. from ferrous metals such as stainless steel using investment casting). Such casting can allow more complicated post profiles to be produced.

In one embodiment each locator is tube-like (e.g. it may be formed from tube). In this regard, each locator can be cut (e.g. by laser) from a metal tube (e.g. of standard, available tubestock). The cutting can also be controlled whereby each cut defines adjacent locators, thereby minimising material wastage.

The dimension of post and tube-like locator can be selected such that the locator closely (snugly) receives its respective post therein once the infill tray is positioned in the base tray.

In one embodiment at least one of the tube-like locators can be provided, at its distal end, with a cut-out in a tube wall. In this embodiment, at least one corresponding post can be provided with a projecting lug located for aligning with and for snug receipt in the cut-out, once the infill tray is positioned in the base tray. This interlocking interaction of the post lug with the tube wall at the cut-out can function to prevent rotation of the infill tray with respect to the base tray, but can still allow for easy removal (lifting off) of the infill tray for servicing etc. The cut-out and lug are typically provided for one or a predetermined number of post-locator combinations (i.e. to make grate assembly simple and foolproof, whereby the infill tray locates in the base tray in just one-way).

In one embodiment a proximal end of each post is shaped for fastening in a corresponding hole defined (e.g. punched) in the base tray. For example, the post proximal end can be welded, riveted or stamped in its corresponding hole.

In one embodiment a proximal end of each locator can be shaped for fastening in one or more corresponding apertures defined in the infill tray. In this embodiment the proximal end of each locator can be castellated to define protruding lugs thereat. Each such lug may be shaped to be fasteningly received in a corresponding slot that is defined (e.g. pre-cut) in the infill tray. Once the lug is so located, the fastening can be by way of stamping or riveting.

In one embodiment the weir grate can further comprise a plurality of seals. Each seal can be shaped for positioning at a circumferential groove defined in a distal end of each post. Each seal can be further shaped so as to sealingly engage the locator once the infill tray is positioned in the base tray. Each seal can comprise a gasket of elastomeric material that is deformed between the locator and around the post once the infill tray is positioned in the base tray. This deformation can help secure the infill tray to the base tray. The seals can thus provide a retention function, as well as providing impact absorption and cushioning for various loads (lateral, vertical, etc) placed on the infill tray in use.

In one embodiment the posts are spaced discretely and evenly around an interior of the base tray, and so as to evenly space a periphery of the infill tray from an internal surface of the base tray (i.e. to provide an even waterway around the weir grate periphery in use). The post/locator height can also be controlled to ensure optimal spacing between the infill tray and base tray. Thus, the post selection and location can ensure a correct and foolproof positioning of the infill tray during installation.

In one embodiment the outlet can comprise a hole that is typically centrally located in a plate of the base tray.

However, there is no reason why an off-centre outlet cannot be produced (e.g. on demand).

In one embodiment the plate of the base tray is stepped down to the outlet. This step-down can be used to mount different sized (e.g. standard sized) outlet tubes to the base tray (as defined below).

In one embodiment the infill tray comprises a plate, with an upstanding wall defined around a periphery of the plate. Such an infill tray can receive e.g. a flooring material within a recess defined by the peripheral wall, with the wall surrounding and protecting the flooring material. In another embodiment, the infill tray simply comprises a plate (i.e. with no upstanding peripheral wall). This latter infill tray can simply have e.g. the flooring material located thereon (e.g. adhesively fastened thereto). This latter infill tray configuration is also particularly suitable for a slab-like flooring material (e.g. a natural or synthetic stone slab).

In one embodiment the base tray also comprises a plate, with an upstanding wall defined around a periphery of the plate. The base tray may further comprise a lip that projects laterally from and around the peripheral wall. This lip can provide e.g. a surface for adjacent flooring material to be located thereon (e.g. adhesively fastened thereto).

The weir grate as set forth above can be mostly formed from sheet metal. The sheet metal may be of stainless steel or other ferrous metal, or of a non-ferrous metal. The weir grate may require little in the way of surface finishing.

Also disclosed is a method for constructing from sheet metal a weir grate as set forth above. The method comprises the steps of:

- forming respective apertures, at locations that correspond to each of the posts and locators, in suitably sized metal sheets for each of the base and infill trays;
- press-forming the base tray and optionally the infill tray from the metal sheets;
- fastening a proximal end of each of the posts and locators at a respective aperture.

The apertures can be formed by being punched or cut (e.g. laser cut) into the sheets. This may occur after press-forming each of the base and infill trays, though typically the punching or cutting is effected whilst the sheet is flat (i.e. prior to press-forming). Also, the apertures can be formed even prior to when individual sheets for the base and infill trays are punched or cut from a larger metal sheet.

When the infill tray comprises an upstanding wall defined around a periphery thereof, then the infill tray can also be press-formed from the metal sheet. When, the infill tray simply comprises a plate (i.e. with no upstanding peripheral wall) then there is no need for a press-forming step.

In one embodiment each suitably sized metal sheet for each of the base tray and infill tray is first punched or cut from a larger metal sheet.

In one embodiment the apertures that are formed in the sheet for the base tray comprise holes. Each hole can be made circular for fasteningly receiving therein a circular projection defined at the post proximal end.

In one embodiment the apertures that are formed in the sheet for the infill tray comprise slots. Each slot can take the form of an arc for fasteningly receiving therein a projection from the locator proximal end that has a correspondingly arced profile.

In one embodiment each post can be machined (e.g. in a suitably controlled lathe) from solid metal rod (e.g. of standard, widely available rodstock), or it can be cast (e.g. by investment casting). In one embodiment each locator can be cut (e.g. by laser) from a metal tube (e.g. of standard, available tubestock). Thus, in the construction method, the posts and locators can be mass produced and stockpiled, ready for fastening (e.g. welding of the post and stamping or riveting of the locator) into their respective apertures in the base and infill trays.

In one embodiment, when each of the suitably sized metal sheets for the base and infill trays is press-formed, a plate can be formed in the tray, and peripheral walls can be folded up about the plate. The plate for the base tray can be press-formed so as to slope towards the outlet (i.e. for drainage). Alternatively, a so-called "cross-break" can be brake-pressed into the tray to impart a sloping in the plate.

The plate for the base tray can additionally be formed (e.g. press-formed or stamped) so as to step down towards the outlet. Each step can correspond to a different sized outlet pipe (e.g. of different standard diameters) to better enable mounting of the pipe to the base plate (as defined below). The outlet pipe is typically positioned in and fastened to the outlet prior to the step of positioning the infill tray in the base tray.

In one embodiment, when the weir grate comprises three or more sides, the peripheral walls can be folded up so as to each define a respective side. Once so folded, the edges of adjacent peripheral walls can abut or closely face. Then, the adjacent edges can be welded together, and then finished and polished as necessary to provide a smooth finish at the joined edges. This technique allows a "tight" corner to be formed (i.e. the formation of a round is avoided at the join of the walls, which round is otherwise required with a cast tray).

The construction method can comprise a further step of positioning the infill tray in the base tray so that each locator engages with a respective post. This positioning can occur at assembly of the components and prior to packaging and shipping, or in situ (i.e. during installation).

The construction method can comprise a further step of locating a sealing gasket on a distal end of each post prior to the step of positioning the infill tray in the base tray.

The construction method can comprise a further step of forming holes in a base plate of the infill tray. These holes can provide for drainage from the infill tray of water that may enter therein.

The construction method can comprise a further step of connecting an overlay to the infill tray, prior to or after the step of positioning the infill tray in the base tray.

Also disclosed is a method of installing a weir grate as set forth above, or as constructed according to the method as set forth above. The method of installing a weir grate comprises the steps of:

- connecting the outlet of the base tray to a drain pipe;
- attaching an overlay to the infill tray;
- positioning the infill tray in the base tray.

In the installation method the overlay can be connected to the infill tray prior to or after the step of positioning the infill tray in the base tray.

In the installation method as set forth above the outlet that is connected to the drain pipe can comprise the outlet pipe as mounted to the base tray in accordance with the construction method as set forth above. In this regard, prior to installation, a manufactured weir grate is selected that has an outlet and outlet pipe that matches the drain pipe.

Also disclosed is a base tray for a grate. The base tray comprises an outlet located in a plate of the base tray. The plate is stepped down (or steps down) to the outlet.

Such a base tray can be suitable for use in the weir grate as set forth above, and can be formed during the method of construction of the weir grate as set forth above. However, such a base tray can be used when constructing other weir grates, making use of the step down feature to enable the mounting of differently sized outlet pipes to the weir grate.

In the base tray as set forth above the outlet is typically centrally located in the plate. The plate can then slope down to the centrally located outlet from a peripheral wall of the base tray. In such a plate, a lowermost step can be surrounded by a next uppermost step, and so on.

In the base tray as set forth above the outlet can be circular, whereby each step can be concentric with the outlet. Then, each next step can be spaced to correspond to a next standard outlet pipe diameter.

In this regard, when manufacturing a base tray that has a given outlet diameter, a plate of the base tray can first be formed to comprise multiple steps that step down to the outlet and that correspond to each of the typical standard sized drain pipes in use. This one base tray can thus form a basic unit or template. When producing a base tray requiring a given outlet diameter that is larger than that of the existing outlet, an outlet can be cut in the base tray template adjacent to its corresponding step. This can be used to produce a base tray for the next drainpipe size up, and so on. In this way, only one base tray template is required to produce base trays for multiple different outlet diameters.

In the base tray as set forth above (as well as in the weir grate as set forth above and in the construction method as set forth above) the outlet pipe that is mounted to the base tray can comprise a peripheral flange that projects laterally from a proximal end thereof. When such an outlet pipe is mounted to the base tray, the peripheral flange can rest on an upperside of the step.

In one embodiment the thickness and width of the flange of the outlet pipe can be selected to correspond to the depth and width of the step whereby, when so mounted, an in-use upperside of the flange sits flush with an in-use upperside of a next adjacent step. This configuration tends to prevent the pooling of water flowing through the weir grate.

In one embodiment, a retaining ring can be fastened to surround the outlet pipe at an underside of the step, opposite to the step upperside. This ring provides a tight fit against the outlet pipe to the base and can be retained by a clip that is spot welded to the pipe. This in turn fastens the outlet pipe to the base tray. The ring may alternatively take the form of a mating sleeve that further comprises a flange projecting laterally from and around an upper periphery of the sleeve, so that the flange sits at the underside of the step when fastened to surround the outlet pipe.

Also disclosed is a base tray for a grate. The base tray comprises a plate, with an upstanding wall defined around a periphery of the plate. The base tray further comprises a lip that projects laterally from and around an in-use upper end the peripheral wall. The base tray may receive an infill tray therein. In use of the base tray, when a respective floor covering is located over each of the infill tray and lip, adjacent edges of the respective floor coverings can be brought into alignment.

This lip can provide e.g. a surface for adjacent flooring material (e.g. a slab-type material) to be located thereon (e.g. adhesively fastened thereto). The lip can be formed when the upstanding wall is formed (e.g. during a press-forming operation). The lip may be provided with a plurality of discrete holes therethrough (e.g. perforated) to enable better bonding with an adhesive.

Also disclosed is an outlet pipe for a base tray of a weir grate. The pipe comprises a peripheral flange that projects laterally from a proximal end of the pipe. The flange is adapted for resting on an upperside of the base tray when the outlet pipe is mounted thereto.

Such a pipe can be easily fastened to the base tray to enable the manufacture of base trays with a range of larger and smaller outlet pipes to suit a particular drainpipe configuration at a given site.

Such a pipe can be used with the stepped base tray as set forth above. In this regard, the thickness and width of the peripheral flange can be selected to correspond to the depth and width of a corresponding step, to achieve the flush configuration (mentioned above) that tends to prevent the pooling of water flowing through the weir grate.

In one embodiment the outlet pipe can include an internal step located intermediate ends of the pipe. The step can receive and locate thereat a trap for foreign matter (e.g. a trap for waste, hair, items (e.g. jewelry), insects (e.g. mosquito), vermin, odours etc). In this regard, the trap can prevent items passing through to the drain, and/or vermin, insects, odours etc passing up from or breeding in the drain.

The outlet pipe can form part of the weir grate as set forth above and can be employed in the method of construction as set forth above, as well as in the method of installation as set forth above.

The outlet pipe as set forth above can further comprise a retainer that is adapted for fastening to the outlet pipe at an underside of base tray opposite to the upperside, to retain the pipe at the base tray. The retainer can take the form of a ring (e.g. a washer) or flanged sleeve that is arranged for being fastened in a tight fit so as to surround the outlet pipe at the base tray. In one embodiment the ring can be separately fastened to the pipe by a retention clip (e.g. a clip band) that is e.g. spot-welded to the pipe, thereby fastening the outlet pipe to the base tray. Alternatively, the ring or sleeve can be directly spot-welded to the outlet pipe.

BRIEF DESCRIPTION OF THE DRAWINGS

Notwithstanding any other forms which may fall within the scope of the grate, base tray, outlet pipe, construction method and installation method as defined in the Summary, specific embodiments will now be described, by way of example only, with reference to the accompanying drawings in which:

FIG. 1A depicts in plan elevation a base tray for a first weir grate embodiment;

FIG. 1B depicts in plan elevation an infill tray for the first weir grate embodiment;

FIG. 1C depicts in a sectioned side elevation the first weir grate embodiment in an assembled configuration;

FIGS. 2*a* and 2*b* depict in side and plan elevation a locator tube for mounting to the underside of the infill tray of FIG. 1B;

FIGS. 2*c* and 2*d* depict in side and plan elevation a post for mounting to the upperside of the base tray of FIG. 1A;

FIGS. 3*a* to 3*c* depict in front, side and plan enlarged elevations of the locator tube of FIGS. 2*a* and 2*b;*

FIGS. 3*d* and 3*e* depict in side and plan enlarged elevations the post of FIGS. 2*c* and 2*d*, and FIG. 3*f* schematically depicts the loads absorbed by a gasket located at a distal end of the post;

FIG. 6C depicts the fourth weir grate embodiment using enlarged sectioned side and sectioned detail elevations.

DETAILED DESCRIPTION OF SPECIFIC EMBODIMENTS

Figure 4B:
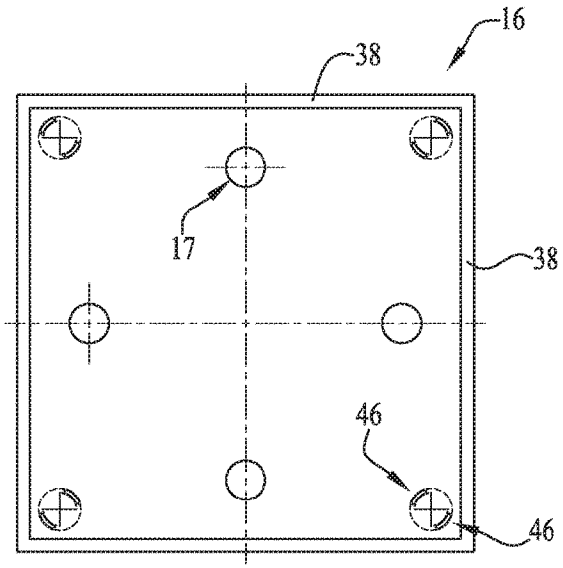
FIG. 4B depicts in plan elevation an infill tray for the second weir grate embodiment.

Referring firstly to FIGS. 1A to 1C, a first weir grate is shown in the form of a grate 10 (FIG. 1C). The grate 10 comprises a base tray 12 that is press-formed from sheet metal, the tray having an outlet in the form of a centrally located circular hole 14. The grate 10 further comprises an infill tray 16 press-formed from sheet metal, the infill tray being positionable in the base tray 12 to define the waterway W of the grate in use. The infill tray comprises four holes 17 punched or cut therein for drainage. An overlay in the form of a suitable surface cap or layer (superstrata) can be adhesively fastened in the infill tray (e.g. prior to finally locating the infill tray in the base tray on site).

An outlet pipe in the form of a first pipe fitting 18 is connected to a plate 20 of the base tray 12 at the hole 14. As shown in FIG. 1C, the plate 20 slopes down to the hole 14 from a peripheral wall of the base tray to promote water flow through the weir grate.

Referring specifically to FIG. 1A, the base tray 12 shown has four side walls 21 and has a square configuration. However, it should be appreciated that the base plate and, in turn, the infill tray and weir grate can have three, five or any desired number of sides, or can be circular, elliptical, etc.

The base tray 12 comprises a plurality of discretely positioned posts in the form of four evenly spaced, solid metal pedestals 22 that are connected to the plate 20 at a stepped region 23, adjacent to the respective corners of the base tray 12, to project upwardly therefrom in use. Each pedestal is located at and is surrounded by a boss 24 that is preformed in the plate 20 during its press forming.

The pedestals enable the infill tray to be easily and evenly located in use with respect to the base tray. The use of pedestals also enables the base tray to be press-formed from sheet metal. In this regard, a metal sheet for the base tray can be punched or cut (e.g. by laser) from a larger metal sheet and can then be press-formed into the tray shape shown. Because the pedestals can be later easily mounted to the base tray, the manufacture of a more complicated cast to achieve the same outcome is not necessary. This enables the base tray to be produced in a low-cost and high-volume manner, also using less material than a casting (e.g. a thinner walled product can be produced).

Each pedestal 22 can be machined (e.g. in a CNC lathe) from a solid metal rod of standard, widely available rod-stock. This further reduces manufacturing time and cost. Where a more complicated pedestal shape is required (e.g. a haunched shape) the pedestals can be cast (e.g. from stainless steel using investment casting). In either case, the pedestals can be mass produced and then stockpiled ready for use.

As best shown in FIG. 3*d* a proximal end 22*p* of each pedestal is shaped to define a stud 26 for fastening in a corresponding hole 28 (FIG. 1C) punched or cut (e.g. by laser) in the base tray. The stud can be welded, riveted or stamped in its corresponding hole.

In an alternative, each pedestal can have a flat base (i.e. no stud 26) and can be inserted into a hole in the base tray that received the pedestal body 34 therein. The underside of the pedestal can then be filet welded to the base tray. To facilitate this welding, for example, the weir grate can be assembled (i.e. infill tray inserted into the base tray), the weir grate inverted, and the pedestal bases then welded into position.

As also shown in FIG. 3*d* a distal end 22*d* of each pedestal is shaped to define a head 30 connected via a neck 32 to a body 34 of the pedestal. This enables an elastomeric gasket 36 to be releasably fastened to the pedestal distal end in the groove defined between the head 30 and body 34, around the neck 32. The gasket 36 is shaped to protrude both vertically and laterally with respect to the pedestal to both secure the infill tray and provide cushioning/impact absorption and lateral support (FIG. 3*f*) as will be described below.

FIGS. 3*d* and 3*e* also show that at least one of the pedestals 22 is provided with a corresponding projecting lug 37 that is located at the proximal end thereof. This lug can align and interlock with a locator component of the infill tray 16, as described below.

Referring specifically to FIG. 1B, the infill tray 16 shown also has four corresponding side walls 38 and has a square configuration (but can have three or a multiple number of sides, be circular, elliptical, etc.). The infill tray is sized smaller than the base tray so as to define a suitable/desired size of waterway W.

The infill tray 16 comprises a plurality of discretely positioned locators mounted thereto in the form of four evenly spaced tube supports 40 that are connected to the underside of a flat plate 41 of tray 16, adjacent to the respective corners thereof, to project downwardly therefrom in use. The tube supports 40 correspond to the pedestals 22 and enable the easy and correct positioning of the infill tray in the base tray, as well as ensuring that the infill tray is evenly spaced and is supported on and above the base tray in use.

Again, by employing tube supports 40 that can be later mounted to the infill tray, the infill tray can be punched or cut from a larger sheet of metal and then press-formed into the tray shape, avoiding the need for a more complicated casting procedure. Again, this contributes to the grate being produced in a cost effective and mass-produced way.

Figure 14:
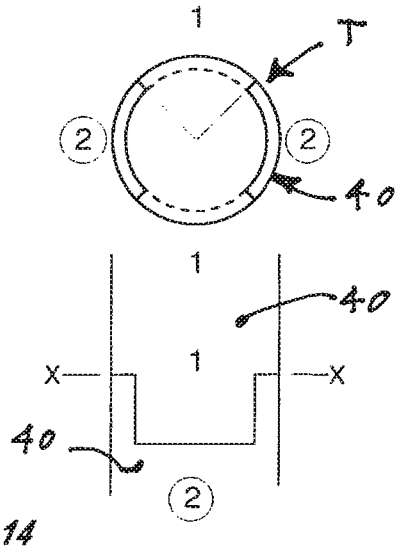
FIG. 14 schematically depicts the cutting of a tube T of standard size to produce a number of like adjacent tube-like locators from a single feed of tubestock.

As illustrated in FIG. 14, each tube support 40 can be cut (e.g. by laser) from a metal tube T of standard, available tubestock dimension. FIG. 14 also illustrates how the cutting can be controlled whereby each cut defines the ends of adjacent tube supports, thereby minimising material wastage, whilst at the same time defining a suitable shape at the proximal end of each tube support for later mounting.

Figure 4A:
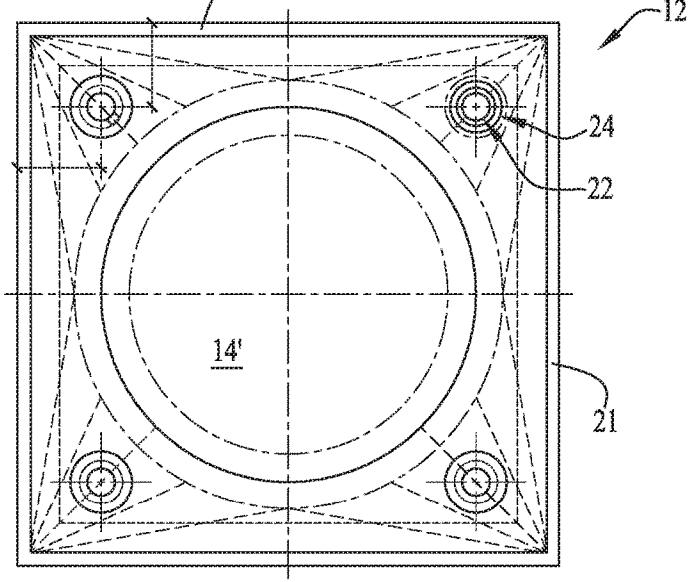
FIG. 4A depicts in plan elevation a base tray for a second weir grate embodiment.
Figure 4C:
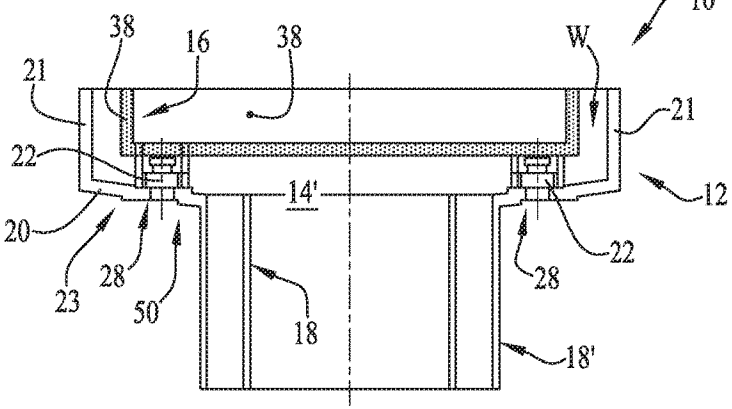
FIG. 4C depicts in a sectioned side elevation the second weir grate embodiment in an assembled configuration.
Figure 11:
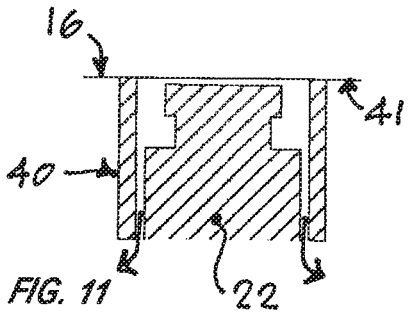
FIG. 11 schematically depicts a section through a tube-shaped locator and a portion of a post, illustrating how water W can drain therefrom.

As shown in FIGS. 1C, 4C and 11, the pedestals and tube supports are dimensioned so that each tube support 40 snugly receives its respective pedestal 22 therein once the infill tray is positioned in the base tray. This enables the vertically and laterally protruding gasket 36 to deform against the interior surfaces defined within the tube support, once the infill tray is fully positioned in the base tray. This deformation helps secure the infill tray to the base tray, with the gasket providing a frictional retention function, as well as providing impact absorption and cushioning for various loads (lateral, vertical etc) placed on the infill tray in use (as illustrated by FIG. 3*f*).

Figure 9:
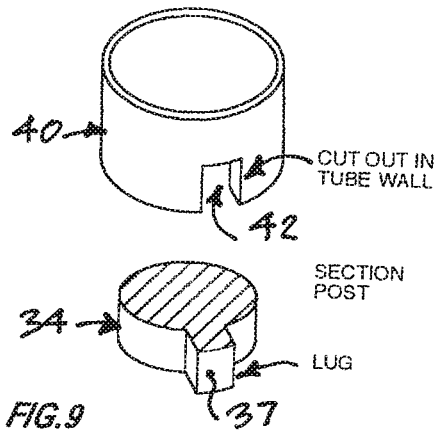
FIG. 9 schematically depicts part of a tube-shaped locator and a sectioned portion of a post, illustrating the interlocking arrangement between the two.
Figure 10:
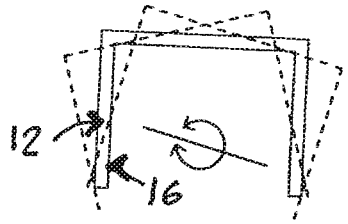
FIG. 10 schematically depicts how this interlocking arrangement prevents rotation of the infill tray with respect to the base tray.

As shown in FIGS. 3*a* to 3*c* and FIG. 9, at least one of the tube supports 40 is cut (e.g. by laser) at its distal end 40*d* with a cut-out 42 in the tube wall. The corresponding projecting lug 37 of pedestal 22 aligns with and is snugly received in the cut-out 42 once the infill tray is positioned in the base tray (as illustrated in FIG. 9). This interlocking interaction of the pedestal lug 37 with cut-out 42 functions to prevent rotation of the infill tray with respect to the base tray (as illustrated in FIG. 10). However, the alignment is such as to still allow for easy removal (lifting off) of the infill tray 16 from base tray 12 for servicing etc. The cut-out and lug can be provided at just one (or a predetermined number) of the pedestal and tube support combinations to ensure foolproof assembly of the weir grate.

Figure 13:
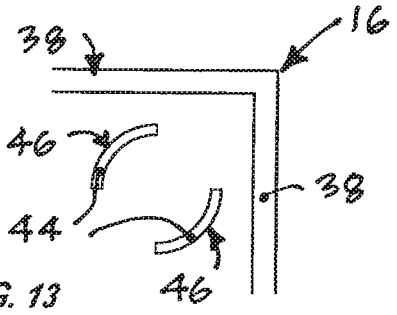
FIG. 13 depicts a corner portion of either a weir grate, showing the arc-shaped slots formed in the infill tray with the locator tube lugs having been stamped/riveted therein.

As illustrated in FIG. 3*b*, a proximal end 40*p* of each tube support 40 is castellated to define two opposing and protruding arced lugs 44 thereat. Each lug can be snugly (e.g. interferingly) received in a correspondingly arced slot 46 defined (e.g. punched or cut) in the infill tray 16 (as illustrated in FIG. 13). Two such slots for the two opposing arced lugs 44 are provided adjacent to each corner of the infill tray 16. Once the lugs are so located, a final fastening of the arced lugs in their respective arced slots can be by way of stamping or riveting.

Figures 5A, 5B, 5C, 5D, 5E:
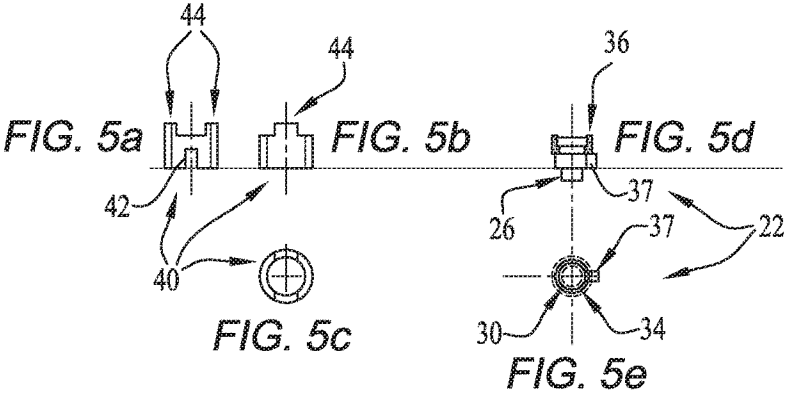
FIGS. 5*a* to 5*c* depict in front, side and plan elevation a locator tube for mounting to the underside of the infill tray of FIG. 4B.
FIGS. 5*d* and 5*e* depict in side and plan elevation a post for mounting to the upperside of the base tray of FIG. 4A.

Referring now to FIGS. 4 and 5, where like reference numerals are used to denote similar or like parts, a smaller weir grate 10' is shown that has a relatively larger outlet 14' as well as a larger outlet pipe 18' (i.e. larger than outlet pipe 18). The grate 10' has essentially the same configuration as the grate 10 of FIG. 1C, except that the pedestals 22 are located on an in-use horizontal section of plate 20 defined between two spaced steps 23 and 50.

Figure 6:
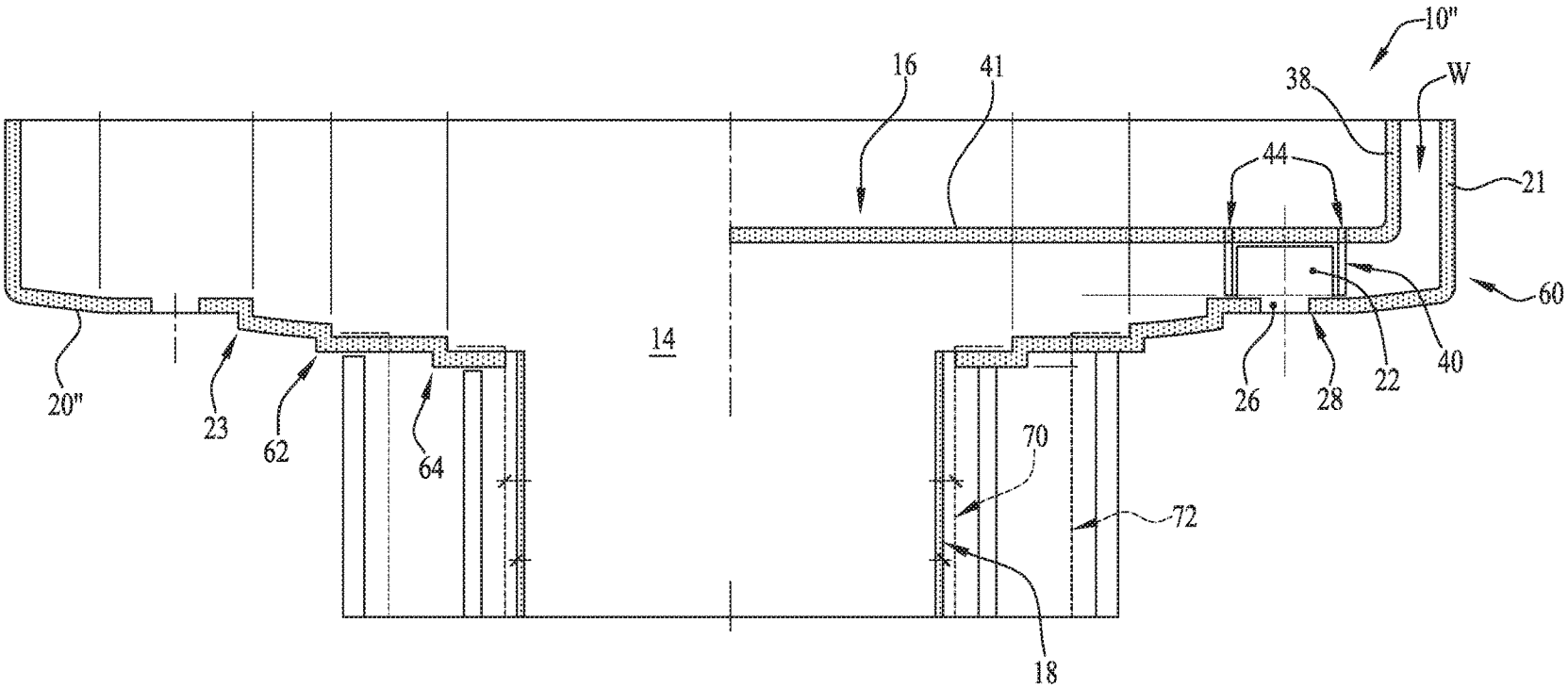
FIG. 6 depicts in a sectioned side elevation a third weir grate embodiment in an assembled configuration, illustrating a stepped down configuration in the base tray.

Referring now to FIG. 6, where like reference numerals are used to denote similar or like parts, a weir grate 10" is shown that comprises a modified base tray 60. Base tray 60 comprises a multiple-step down configuration in the plate 20" to enable the easy and rapid mounting of differently sized outlet pipes to the weir grate (i.e. to produce weir grates with different sized outlet pipes from the one base tray). In this embodiment, plate 20" comprises a series of steps 23, 62 and 64 which have been stamp-formed in the plate 20" to step down to the hole 14, whereby a lowermost of the steps is surrounded by a next uppermost step, and so on. Notwithstanding such steps, the plate 20" still generally slopes down to the outlet to maintain water flow through the weir grate.

When the hole 14 is increased with reference to a given step (e.g. by punching, laser-cutting etc) a successively larger outlet pipe, such as a pipe 70 or a pipe 72 can be attached thereto.

Figure 7:
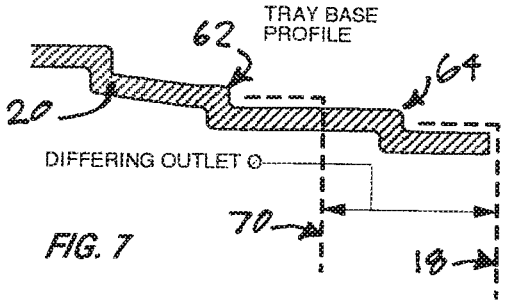
FIG. 7 schematically depicts a detail of part of the stepped down configuration in the base tray, illustrating how differently sized outlet pipes can be mounted at different steps.
Figure 8:
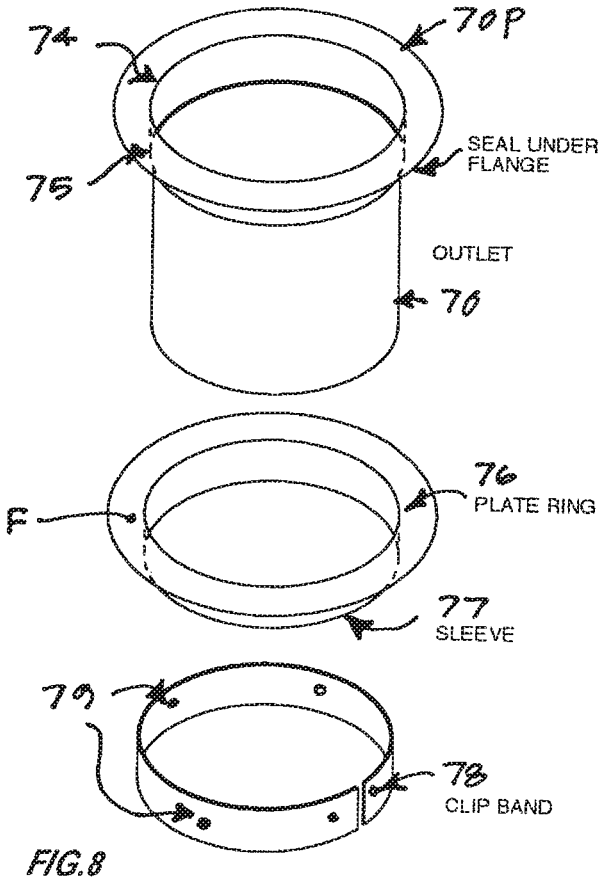
FIG. 8 depicts in perspective view an outlet pipe that is adapted for mounting at a given step, as well as a securing mechanism for fastening the outlet pipe to the base tray.

FIGS. 7 and 8 illustrate a special configuration for one such pipe 70 suitable for mounting to the base tray (16 or 60). The pipe 70 comprises a peripheral flange 74 that projects laterally from a proximal end 70*p* of pipe 70. The thickness and width of the flange 74 is selected to correspond to the depth and width of its corresponding step. Thus, when the pipe 70 is mounted to the plate 20", an in-use upperside of the flange sits flush with an in-use upperside of a next adjacent step. This can define a near continuous surface where the flange peripheral edge meets the step, which tends to prevent residual waste water remaining in the weir grate.

A sealing ring (e.g. an elastomeric O-ring) may also be located under the flange 74. Thus, when pipe is mounted to the base tray the flange 74 can be fastened against an upperside of a given step of plate 20".

As schematically shown in dotted outline in FIG. 8, the pipe 70 can include an internal step 75 located intermediate ends of the pipe. The step can receive and locate thereat a foreign matter trap for e.g. waste, hair, items such as jewelry, and to prevent vermin, insects (such as mosquitoes), odours etc from entering up from or breeding in the drainage waste water.

To securely fasten the pipe 70 to the base tray during manufacture of the base tray, a plate-shaped retaining ring 76 (such as a washer) is fastened in a tight fit and so as to surround the pipe at an underside of the step, opposite to the step upperside of plate 20". The plate ring is retained on the outlet pipe by a clip band 78 that is spot-welded at 79 to the outlet pipe's external surface.

Alternatively, as schematically shown in dotted outline in FIG. 8, the ring may be replaced with a mating sleeve 77 that comprises a flange F projecting laterally from and around its upper periphery, so as to sit at the underside of the step when fastened to surround the pipe 70.

To simplify manufacture, each outlet pipe 18, 70, 72 can correspond to increasing standard sized pipes, which in turn can then easily be mounted to standard drainpipe diameters. The plate 20" can thus be stepped and the outlet 14 can thus be sized in relation to a standard sizing/format.

Whilst the outlet pipes are typically circular in cross-section, whereby each step is then concentric with the outlet, they may have other cross-sectional shapes as desired. However, when connected to a standard drain, a circular shape is desirable to match the drain.

The base tray 60 is suitable for use in the weir grates of FIGS. 1 and 4, but can alternatively be used in other (e.g. known) weir grates.

Figure 15B:
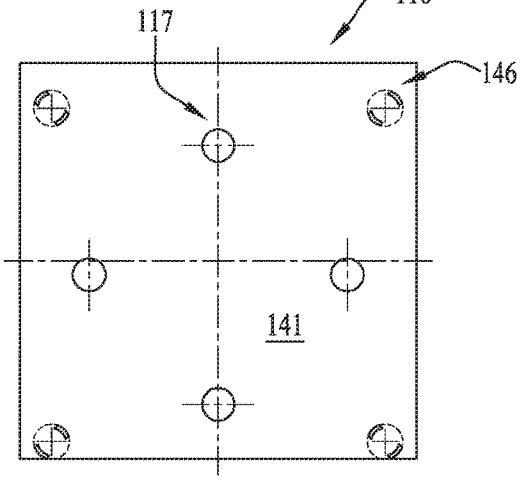
FIGS. 15A to 15C respectively depict in plan, plan and sectioned side elevations a base tray, an infill tray and an assembled weir grate for a fourth weir grate embodiment.
Figure 15A:
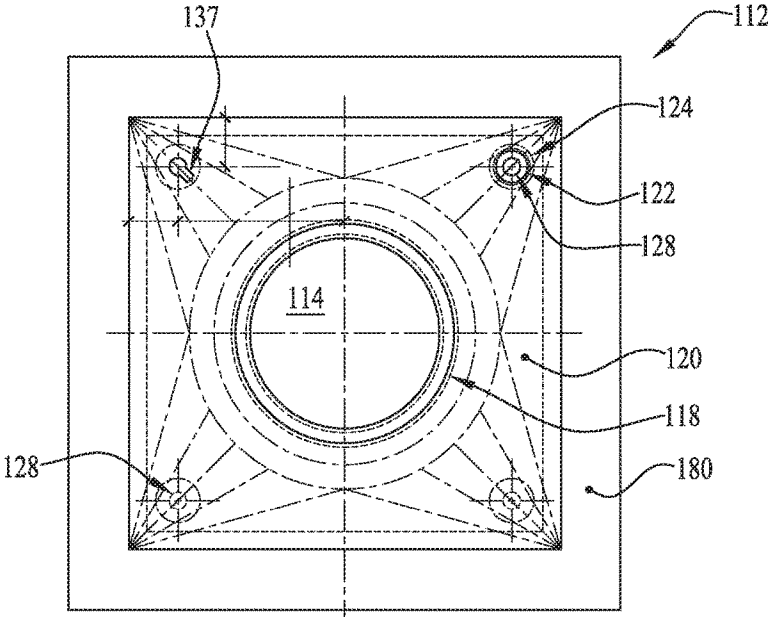
Figure 15C:
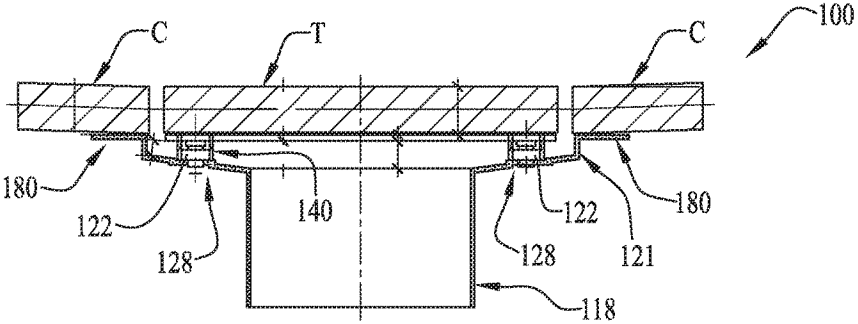

Referring now to FIGS. 15 and 16, a weir grate 100 is shown that comprises a modified base tray 112 and a modified infill tray 116.

The modified base tray 112 again comprises a step down configuration and has an outlet hole 114 for a pipe fitting 118 to the weir grate. The base tray 112 comprises a plate 120 which generally slopes down to the outlet hole to maintain water flow through the weir grate.

The base tray 112 again comprises four evenly spaced bosses 124 and holes 128 in plate 120 to mountingly receive the studs 126 of four respective pedestals 122, one pedestal having a projecting locator lug 137. The square plate 120 is surrounded by four side walls 121 that are again press formed.

The modified infill tray 116 again comprises four holes 117 punched or cut in the plate 141 for drainage, and four pairs of arced slots 146 punched or cut therein to mountingly receive four respective tube supports 140.

The base tray 112 is modified by forming (e.g. press forming or attaching) a lip in the form of a peripheral flange 180 to extend laterally from the four side walls 121. As shown in FIG. 16, such a flange is able to support an overlying covering C (e.g. a floor covering such as one or more slabs or large format tiles, panels, pavers etc) at a periphery of the weir grate 100 in use.

Figures 16A, 16B, 16C:
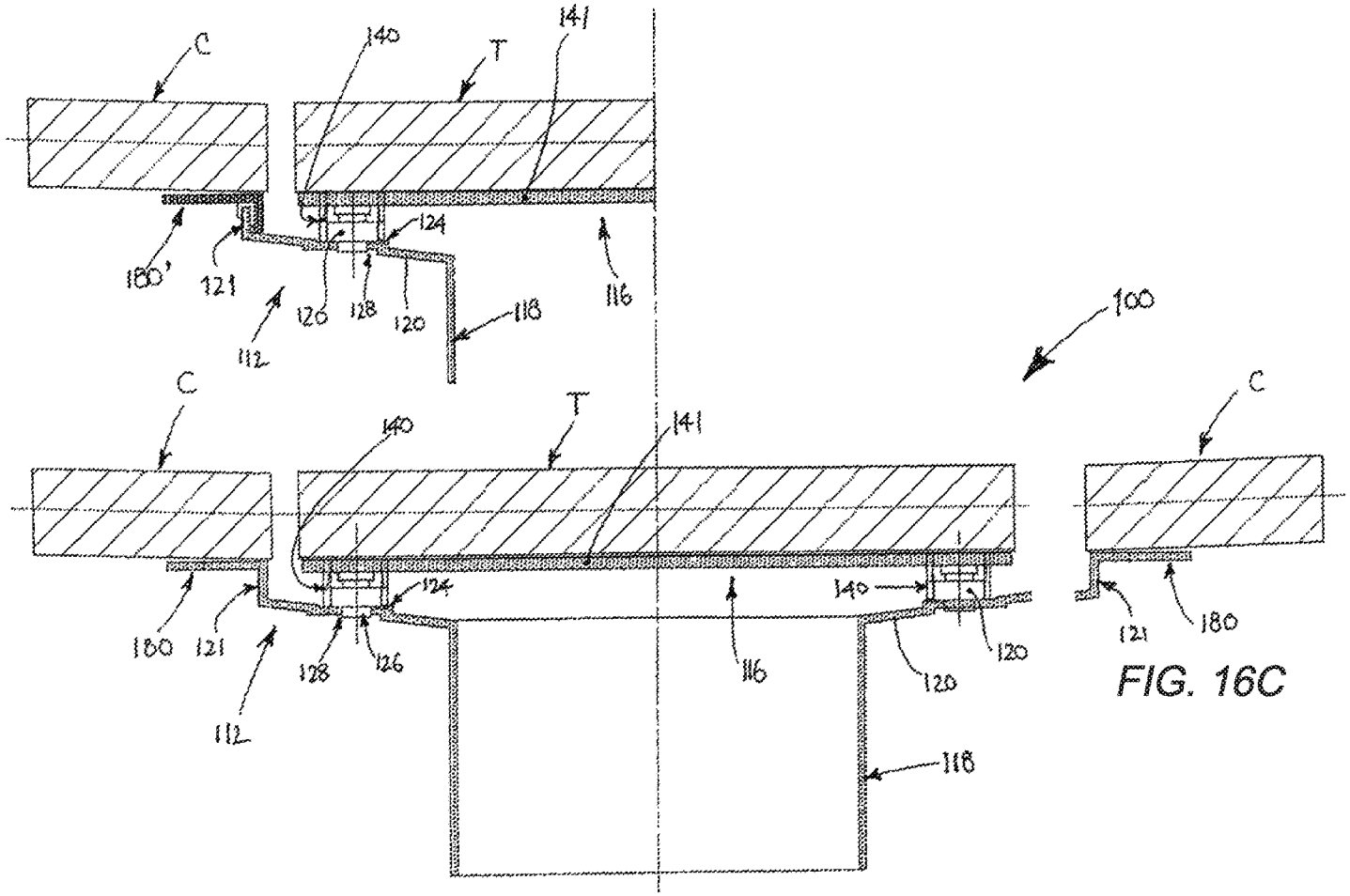
FIGS. 16A and 16B respectively depict the fourth weir grate embodiment using enlarged sectioned side and sectioned detail elevations.

FIG. 16B shows a variation in which the flange 180' comprises a separate component that is mounted (e.g. press-fitted or welded) to the side walls 121. When the separate flange 180' is press-fitted to the side walls this may take place in-situ (i.e. at the time of installing the weir grate 100).

To secure and seal between the separate flange 180' and the remainder of the base tray 112, a specially formed and sized elastomeric gasket can be provided that is arranged along the upper rim of the side walls 121. Press-fitting of the separate flange 180' onto the side walls then deforms this gasket, with this deformation securing the flange 180' to the walls and sealing therebetween.

The infill tray 116 is modified in that the four side walls (e.g. walls 38 in the grate 10 of FIG. 1) are removed altogether from the plate 141. In other words, infill tray 116 simply comprises a flat plate 141, which is accordingly very easy to form and use. As again shown in FIG. 16, such a flat tray is able to support an overlying covering T, for example, a floor covering such as a slab-like material (e.g. a slab or large format tile/panel/paver formed from a natural or synthetic stone material). The flat tray supports the slab-like material centrally above the weir grate 100 in use. In this regard, the covering T can simply be adhesively fastened at its underside to the tray 116, with the sides of the covering just overhanging the tray as shown, to hide the tray 116 from view.

The modified base tray 112 and infill tray 116 enable the weir grate 100 to be effectively hidden in use. Also, joints and corners can be covered and not seen down the weir passage. This can provide desirable aesthetic effects.

Figure 17B:
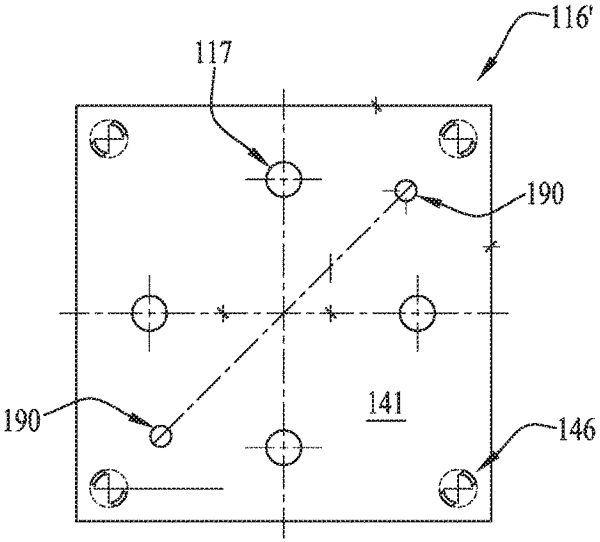
FIGS. 17A to 17C respectively depict in plan, plan and sectioned side elevations a base tray, an infill tray and an assembled weir grate for a fifth weir grate embodiment, being similar to the embodiment of FIGS. 15 and 16.
Figure 17A:
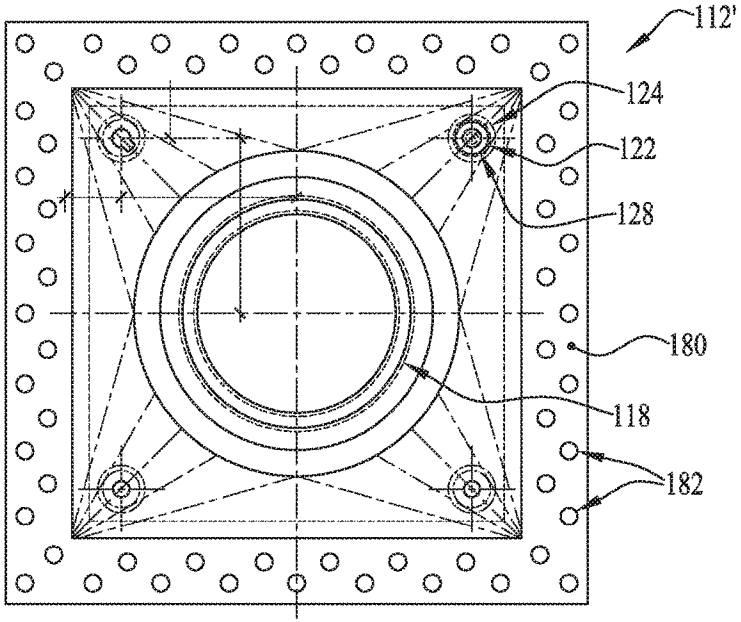
Figure 17C:
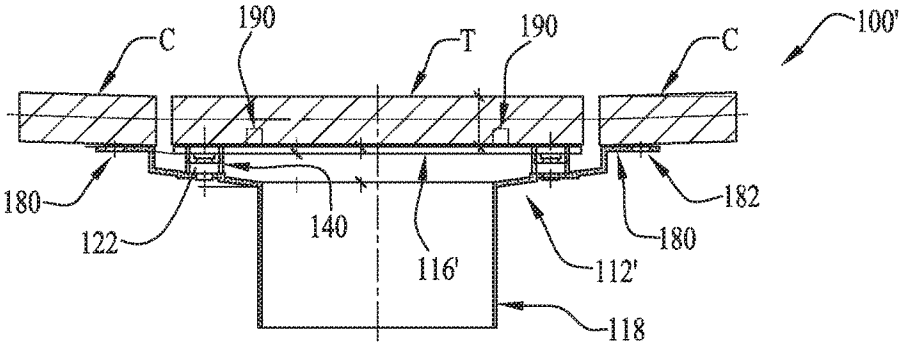

Referring now to FIGS. 17A to 17C, where like reference numerals denote similar or like parts to the weir grate of FIGS. 15 and 16, a weir grate 100' is shown that comprises a modified base tray 112' and a modified infill tray 116' that are, in essence, the same as those shown in FIGS. 15 and 16.

However, in the base tray 112' the flange 180 is provided with a plurality of discrete holes 182 therethrough (e.g. it is perforated). These holes can be punched or cut in the sheet prior to press-forming the base tray. The holes 182 enable better bonding of the flange 180 with an adhesive for the covering T.

Further, in the infill tray 116' two spaced posts 190 are provided to project up from flat plate 141. These posts can be used to align with corresponding holes formed in the underside of covering T (FIG. 17C) to securely locate the covering at the infill tray 116'.

As explained above, the weir grates 10, 10', 10", 100, 100' can mostly be formed from sheet metal. The sheet metal may be of stainless steel or another ferrous or non-ferrous metal. Notwithstanding the use of sheet metal, the aesthetics and design features of the weir grate can be preserved.

In the embodiments described the pedestals 22, 122 are spaced discretely and evenly around an interior of the base tray, and also so as to evenly space the walls/edges of the infill tray 16, 116 from an internal surface of the walls 21, 121 of base tray 12, 112 (i.e. to provide an even weir around the weir grate in use). However, spacing may be selected to provide an uneven weir profile if desired.

In the embodiments described the tube support and pedestal height can be controlled to ensure an optimal spacing between the infill tray and base tray.

Further, the selection and location of the pedestals can ensure a correct and foolproof positioning of the infill tray during installation.

In the embodiments described the outlet hole is centrally located in the base plate, although in some applications a one-off base tray may be produced that has an off-centre outlet.

EXAMPLE 1

Method of Constructing a Weir Grate

Figure 12:
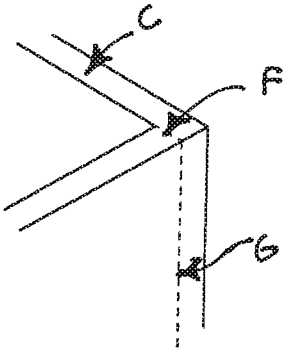
FIG. 12 schematically depicts a corner portion C of either an infill tray or base tray, illustrating a fold-up F of the tray sides, as well as the location for a corner weld and finishing grind G.

A method of constructing one of the weir grates 10, 10', 10" described comprised the following steps:

1. Determining, on a large stainless steel sheet, locations for the base tray 12 and infill tray 16, and for the apertures 28, 46 and holes 14, 17.
2. Punching or cutting (e.g. by laser) the respective apertures and holes, at locations that correspond to each of the pedestals 22 and tube supports 40, in suitably sized metal sheets for each of the base and infill trays.
3. Die-press or laser cutting-out the metal sheets for each of the base and infill trays.
4. Press-forming each of the base and infill trays from their respective metal sheets, so as to form the corners C by the folding up F of the walls (21 or 38) as shown in FIG. 12. During such press-forming the slope in the plate 20, 20" and the bosses 24 etc can be defined, and the steps 23, 50, 62, 64 can be stamped into the plate.
5. Welding together and the grinding smooth the corners C as shown by G in FIG. 12.
6. Machining from a standard rodstock (e.g. by CNC lathe) or investment casting each of the pedestals 22, including at least one pedestal per base tray that has a lug 37.
7. Cutting (e.g. by laser) each of the tube supports 40 from a standard tubestock (FIG. 14).
8. Weld-fastening the stud 26 of each pedestal 22 in a respective hole 28.
9. Fastening the lugs 44 of each tube support 40 in their respective arced slots 46 using stamping or riveting.
10. Fastening the outlet pipes 18 (or 70, 74) in their correspondingly sized holes 14, making use of the flange 74, the plate ring 76 and the spot-welded clip band 78.
11. Grinding and polishing any of the resultant pieces, as required/desired, to provide a suitable surface finish to the resultant weir grate.
12. In a factory or on-site, adhesively fastening a surface cap or layer to the infill tray.
13. Positioning the infill tray in the base tray so that each tube support 40 engages with and snugly receives a respective pedestal 22 therein. During this step the gasket 36 is deformed against the inside of the tube support walls. Positioning of the infill is completed when the upper surface of the gasket abuts the underside of infill plate 41.

14. Packaging the assembled weir grate, ready for shipping.

It was noted that for smaller volume production runs laser cutting could be employed for the apertures and holes and to produce the suitably sized metal sheets for each of the base and infill trays. For larger volume production runs the apertures and holes could be punched into the sheets as they are formed as part of a die press-cutting operation.

It was further noted that for a weir grate 100, 100' step 4, comprised press-forming only the base tray 112 from its respective metal sheet, and so as also to form the flange 180. No press-forming was required for infill tray 116.

EXAMPLE 2

Method of Installing a Weir Grate

A method of installing one of the pre-packaged weir grates 10, 10', 10",100 described above comprised the following steps:

1. Detaching the infill tray from the base tray so that each tube support 40, 140 releases its respective pedestal therefrom.
2. Connecting the outlet pipe 18 (or 70, 74, 118) of the base tray to a drainpipe.
3. Affixing the base tray in a floor (e.g. using a tiling cement, or other adhesive or fastener).
4. Adhesively fastening an overlay (e.g. a tile) in/to the infill tray.
5. Tiling (or otherwise covering) the floor up to (or over the flange 180 of) the base tray.
6. Re-positioning the infill tray in the base tray.

In this installation method a base tray with the right-sized outlet pipe for the given drainpipe diameter is prior-selected.

In this installation method the overlay may comprise a tile (or a part thereof) that matches the surrounding tiles used on the floor, or may comprise e.g. a decorative cap (such as of polished stainless steel), or other covering.

Whilst a number of specific grate, construction and installation embodiments have been described, it should be appreciated that the grate and its method of construction and installation may be embodied in other forms.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the grate and its construction and installation methods.

The invention claimed is:

1. A weir grate system, comprising a base tray and an infill tray, the base tray comprising a plate, the plate comprising an upstanding wall arranged to form a periphery of the plate, the base tray further comprising a lip that projects laterally from and around an in-use upper end of the peripheral wall;

the infill tray comprising a plate; and a plurality of posts arranged between the plate of the base tray and the plate of the infill tray, the posts being configured to space the plate of the infill tray such that it is aligned with the laterally projecting lip of the base tray, and so as to define a waterway that surrounds the infill tray and that is located between the infill tray and the base tray.

2. A weir grate system as claimed in claim 1, wherein the lip is:

(i) integrally formed with the upstanding wall at the plate periphery; or (ii) a separate component that is mounted to the upstanding wall at the plate periphery.

3. A weir grate system as claimed in claim 2, wherein in (ii) the lip is mounted by press-fitting or welding to the upstanding wall at the plate periphery.

4. A weir grate system as claimed in claim 3, wherein when the lip is mounted by press-fitting a deformable gasket is provided along an upper rim of the upstanding wall, between the upper rim and the lip.

5. A weir grate system as claimed in claim 1, wherein the lip comprises a plurality of discrete holes therethrough around the periphery of the plate.

6. A weir grate system as claimed in claim 1, the weir grate system further comprising an overlying floor covering, wherein each of the base tray and received infill tray are arranged such that, when a respective floor covering is located over each of an upper surface of the infill tray and an upper surface of the lip of the base tray, adjacent upper edges of the respective floor coverings are able to he brought into level alignment.

7. A weir grate system as claimed in claim 1, wherein the plurality of posts are discretely positioned projecting upwardly from the base tray in use, and the tray comprises a plurality of correspondingly positioned locators projecting downwardly therefrom in use, each locator arranged for engaging with a respective post when the infill tray is received in the base tray.

8. A weir grate system as claimed in claim 7, wherein each post is solid and each locator is tube-like to closely receive its respective post therein once the infill tray is positioned in the base tray.

9. A weir grate system as claimed in claim 8, wherein at least one of the tube-like locators is provided, at its distal end, with a cut-out in a tube wall, and at least one corresponding post is provided with a projecting lug located for aligning with and for snug receipt in the cut-out once the tray is positioned in the base tray.

10. A weir grate system as claimed in claim 7, wherein each post comprises a circumferential groove defined at a distal end of the post, with a deformable seal being positioned at each respective circumferential groove, the seal being shaped so as to sealingly engage the locator once the infill tray is positioned in the base tray.

11. A weir grate system as claimed in claim 7, wherein the posts are spaced discretely and evenly around an interior of the base tray, and so as to evenly space a periphery of the infill tray from an internal surface of the base tray.

12. A weir grate system as claimed in claim 1, wherein the base tray comprises an outlet that is centrally located in a base plate of the base tray.

13. A weir grate system as claimed in claim 12, wherein the outlet comprises a hole in the base plate, and a given size of outlet pipe is mounted at the outlet hole to extend down from the base plate.

14. A weir grate comprising a base tray and an infill tray, the base tray comprising a plate, the plate comprising an upstanding wall arranged to form a periphery of the plate, the base tray further comprising a lip that projects laterally from and around an in-use upper end of the peripheral wall, the infill tray comprising a plate, wherein, when the infill tray is received in the base tray, the infill tray defines a waterway that surrounds the infill tray and that is located between the infill tray and the base tray;

wherein each of the base tray and received infill tray are arranged such that, when a respective floor covering is located over each of the infill tray and lip of the base tray, adjacent upper edges of the respective floor coverings are able to be brought into a level alignment so as to define a continuous floor on either side of the waterway therebetween.

15. A weir grate as claimed in claim 14, wherein the lip comprises a plurality of discrete holes therethrough around the periphery of the base tray plate.

16. A method of installing a weir grate as defined in claim 14, the method comprising the steps of:

connecting the base tray to a drain pipe;

attaching an overlay to the infill tray plate;

positioning the infill tray in the base tray.

17. A method as claimed in claim 16, further comprising attaching an overlay over the lip of the base tray, whereby adjacent edges of the respective overlays are able to he brought into alignment and so as to further define the waterway.

* * * * *